US008105187B1

(12) United States Patent
Sanford

(10) Patent No.: US 8,105,187 B1
(45) Date of Patent: Jan. 31, 2012

(54) ARROW BROADHEAD WITH PIVOT ARMS FOR RETRACTING AND EXTENDING ATTACHED CUTTING BLADES

(76) Inventor: Chris G. Sanford, Billings, MT (US)

( * ) Notice: Subject to any disclaimer, the term of this patent is extended or adjusted under 35 U.S.C. 154(b) by 206 days.

(21) Appl. No.: 12/590,393

(22) Filed: Nov. 5, 2009

Related U.S. Application Data

(63) Continuation-in-part of application No. 11/810,285, filed on Jun. 5, 2007.

(51) Int. Cl.
*F42B 6/08* (2006.01)

(52) U.S. Cl. ..... 473/583

(58) Field of Classification Search ..... 473/583
See application file for complete search history.

(56) References Cited

U.S. PATENT DOCUMENTS 2,993,697 A * 7/1961 Urban ..... 473/583
4,973,060 A * 11/1990 Herzing ..... 473/583
4,976,443 A * 12/1990 DeLucia ..... 473/583
4,998,738 A * 3/1991 Puckett ..... 473/583
5,066,021 A * 11/1991 DeLucia ..... 473/583
5,082,292 A * 1/1992 Puckett et al. ..... 473/583
6,165,086 A * 12/2000 Liechty, II ..... 473/583
6,200,237 B1 * 3/2001 Barrie ..... 473/583
6,517,454 B2 * 2/2003 Barrie et al. ..... 473/583
6,669,586 B2 * 12/2003 Barrie et al. ..... 473/583
7,226,375 B1 * 6/2007 Sanford ..... 473/583

* cited by examiner

*Primary Examiner* — John Ricci
(74) *Attorney, Agent, or Firm* — Edwin H. Crabtree; Ramon L. Pizarro

(57) ABSTRACT

An arrow broadhead adapted for attaching to an open end of a hollow arrow shaft. The broadhead is adapted for moving from a retracted position during arrow flight to an extended and fully-locked position when contacting a target. The broadhead includes a pointed tip with tip base and a sliding shaft. A sliding shaft housing with a bore hole is used for receiving the sliding shaft therein. A lower end of the sliding shaft housing is adapted for receipt inside the open end of the hollow arrow shaft. At least two cutting blades are pivotally attached at one end to the tip base. Pivot arms are pivotally attached to an inside edge of the cutting blades and to the sliding shaft housing. The pivot arms hold the cutting blades in a retracted position during arrow flight and expand the cutting blades outwardly upon target contact.

18 Claims, 6 Drawing Sheets

ARROW BROADHEAD WITH PIVOT ARMS FOR RETRACTING AND EXTENDING ATTACHED CUTTING BLADES

This application is a Continuation-In-Part patent application of an application filed on Jun. 5, 2007, Ser. No. 11/810,285, by the subject inventor and having a title of "EXPANDABLE ARROW BROADHEAD WITH TWO-PIECE FOLDING CUTTING BLADES". The inventor/applicant claims the benefit of this earlier filed application.

BACKGROUND OF THE INVENTION (a) Field of the Invention

This invention relates broadly to an expandable arrow broadhead and more particularly, but not by way of limitation, to an arrow broadhead having a sliding shaft with a pointed tip. The sliding shaft is received in a sliding shaft housing. The housing is adapted for attaching to a hollow end of an arrow shaft. The broadhead is characterized by having at least two cutting blades attached to a lower portion of the pointed tip and attached to one end of pivot arms. The pivot arms include an elastic band mounted thereon. An opposite end of the pivot arms is attached to the side of an upper portion of the sliding shaft housing. During arrow flight, the cutting blades are held in a retracted position by the pivot arms and the elastic band. Upon target contact, the cutting blades are extended outwardly from the side of the sliding shaft housing for increased cutting and penetration in the target.

(b) Discussion of Prior Art

Heretofore, there have been a number of arrow broadheads having blades that extend outwardly when contacting a surface of a target. U.S. Pat. No. 6,935,976 to Grace, Jr. et al., discloses a mechanical broadhead having blades, mounted in longitudinal channels in a ferrule, that slide outwardly on a camming surface formed in an inward edge of each blade. U.S. Pat. No. 6,270,435 to Sodaro illustrates an arrowhead having spring loaded blades that expand outwardly upon contact with a target. U.S. Pat. Nos. 6,910,979, 6,626,776 and 6,517,454 to Barrie et al. disclose blades having longitudinal grooves in the blades and a camming member for extending the blades outwardly upon target impact. U.S. Pat. Nos. 6,669,586 and 6,200,237 to Barrie disclose blades mounted on a sliding body mounted on a length of the broadhead. As the sliding body moves rearwardly upon target impact, the blades engage a camming surface and are moved outwardly in an extended position. Also, U.S. Pat. No. 4,973,060 to Herzing discloses an arrowhead with expandable, cutting blades having link arms attached to the inside of the cutting blades. This arrowhead doesn't provide for having pivot arms with an elastic band that both expand the cutting blades into a fully-locked position on target contact and then retract the cutting blades when the arrowhead is removed from a target.

None of the above mentioned prior art broadhead patents particularly disclose or teach the structure and function of the subject arrow broadhead having a sliding shaft with a pointed tip and at least two cutting blades with pivot arms attached to the inside of the cutting blades. The sliding shaft is designed to move rearwardly upon target impact with the pivot arms extending the cutting blades outwardly from the sliding shaft housing and locking the blades open for increased cutting and target penetration and then retracting the cutting blades when removing the broadhead from the target.

SUMMARY OF THE INVENTION

In view of the foregoing, it is a primary objective of the subject invention to provide an aerodynamic, arrow broadhead that maintains at least two cutting blades in a retracted position, typically having an in-flight diameter less than 1 inch and next to a sliding shaft housing for little or no wind planing during arrow flight. The arrow broadhead flight is similar to an arrow with field tip flight. This feature eliminates the need to adjust sight pins, which is a common complaint of mechanical and fixed broadheads, especially with bows that shoot over 300 fps. The folding cutting blades are held in the retracted position and an extended position using pivots arms with an attached elastic band.

Another key object of the broadhead is the pivot arms with the elastic band hold the cutting blades in a retracted position during arrow flight, hold the cutting blades in an extended position during target contact, and allow the cutting blades to be folded back into the retracted position for ease in release, when the broadhead is pulled outwardly from the target.

Still another primary objective of the invention is using the broadhead's forward inertia and using a sliding shaft moving rearward in a sliding shaft housing to almost instantaneously upon target contact move the cutting blades into a fully extended position. The forward inertia of the arrow broadhead and the extension of the blades provide for an ultimate penetration of the target. This feature results in larger entry and exit holes, better blood trails and higher game recovery.

The subject arrow broadhead includes at least two cutting blades pivotally attached to a tip base of a pointed tip with sliding shaft. The sliding shaft is received in a bore hole in a sliding shaft housing. A lower portion of the housing is adapted for attaching to a hollow end of an arrow shaft. The inside of the cutting blades are attached to one end of pivot arms with an elastic band mounted thereon. An opposite end of the pivot arms is attached to an upper portion of the sliding shaft housing. During arrow flight, the cutting blades are held in a retracted position by the pivot arms and the elastic band. Upon target contact, the pivot arms are extended outwardly 90 degrees and greater from the side of the sliding shaft housing, which puts the cutting blades into a fully-locked position for increased cutting and penetration in the target.

These and other objects of the present invention will become apparent to those familiar with the use of arrow broadheads for hunting and target shooting when reviewing the following detailed description, showing novel construction, combination, and elements as described, and more particularly defined by the claims, it being understood that changes in the embodiments to the disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for it's practical application and in which.

DETAILED DESCRIPTION OF THE PREFERRED EMBODIMENTS

Figure 1:
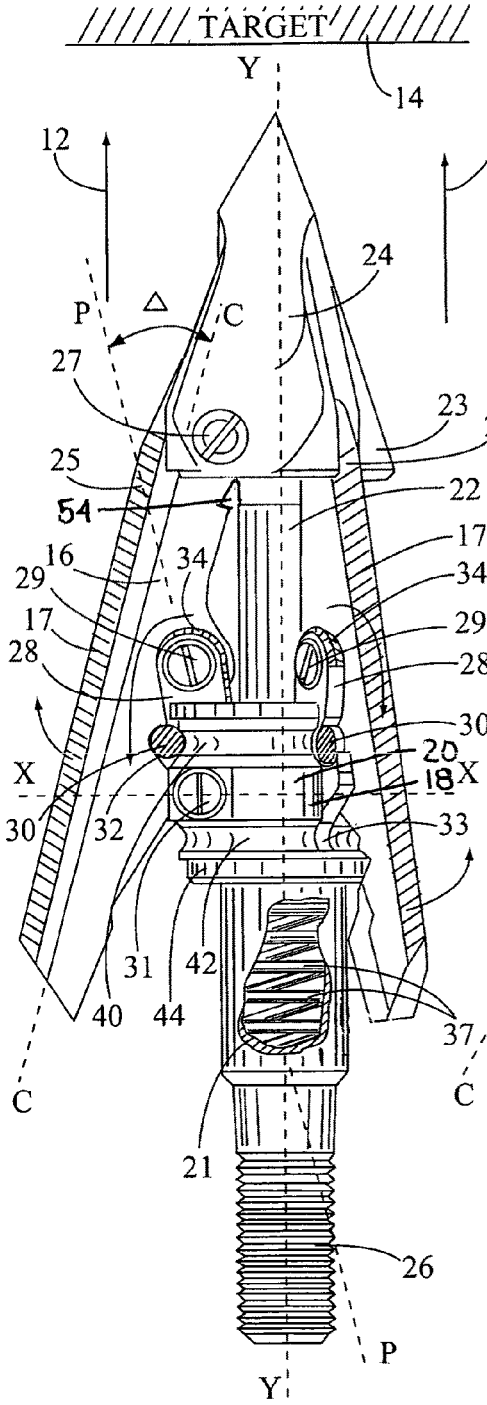
FIG. 1 is a perspective view of the subject arrow broadhead with pivot arms and elastic band holding the cutting blades in a retracted position during arrow flight and prior to target contact.

In FIG. 1, a perspective view of the subject arrow broadhead, having general reference numeral 10, is shown in flight as indicated by arrows 12, and prior to contacting a target 14. In this drawing, at least two cutting blades 16 with a beveled cutting edge 17, are shown in a retracted position next to a side of an upper portion 18 of a sliding shaft housing 20. The cutting blades 16 can be curved for a lower profile during arrow flight.

The sliding shaft housing 20 includes a bore hole 21 therein for receiving a sliding shaft 22 therein. An upper portion of the sliding shaft 22 is attached to a tip base 23 of a pointed tip 24. The pointed tip 24 is tapered rearwardly and outwardly forming the tip base 23. The tip 24 can include a flat, oval or similar shaped extension that slides inwardly on a housing or body for proper blade alignment and prevent the tip and cutting blades from twisting at target contact. One end 25 of the cutting blades 16 is attached to the tip base 23 using a pin 27, a rivet or screw. A threaded, lower portion 26 of the sliding shaft housing 20 is adapted for attaching to an arrow shaft insert in a hollow arrow shaft. The arrow shaft insert and hollow arrow shaft aren't shown in the drawings. The length of the sliding shaft housing 20 and the sliding shaft 22 are shown oriented and disposed along a vertical center line Y-Y.

Figure 2:
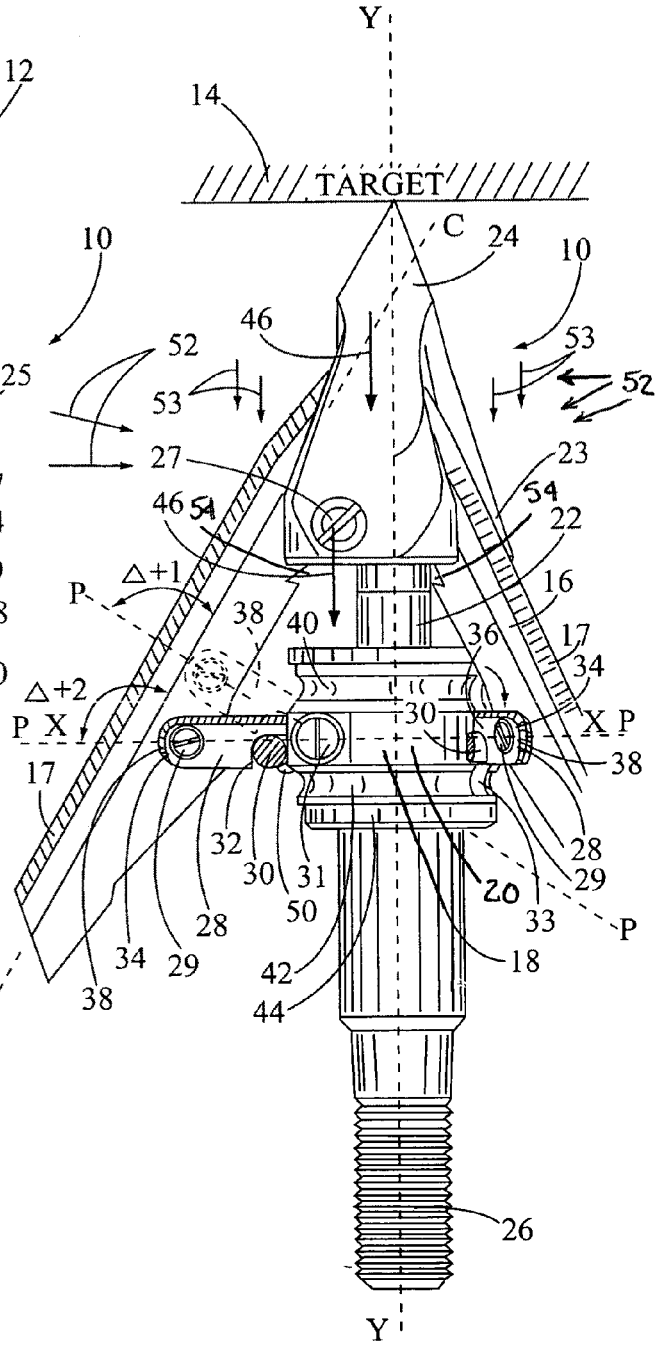
FIG. 2 is another perspective view of the arrow broadhead with the pivot arms fully-extended 90 degrees from a vertical center line of the sliding shaft housing and extending the cutting blades upon initial target contact prior to moving the cutting blades into a fully-locked position.

A key feature of the subject arrow broadhead 10 is the use of pivot arms 28 with an elastic band 30. The elastic band 30 is shown in cross section in the drawings. The elastic band 30 is used to bias the pivot arms 28 and cutting blades 16 inwardly in a retracted position and next to the sliding shaft housing 20 during arrow flight. The elastic band 30 is received in a band notch 32 in a lower portion of the pivot arms 28. One end 34 of the pivot arms 28 is pivotally attached using a pin 29, a rivet or screw to the cutting blades 16. An opposite end 36 of pivot arms 28, shown in FIG. 2, is attached using a pin 31, a rivet or screw to a side of the upper portion 18 of the sliding shaft housing 20. The opposite end 36 of the pivot arms 28 is received in a pivot arm slot 33 in the housing.

Also, a coil spring 37 is shown mounted in the bottom of the bore hole 21. The coil spring 37 is an optional feature and is used to engage the bottom of the sliding shaft 22 and bias it upwardly for holding the cutting blades 16 in a retracted position during arrow flight. This feature will eliminate the need of using an elastic band, "O" ring and the like for receipt around the cutting blades or attached to the cutting blades during arrow flight.

It should be noted for the pivot arms 28 to properly extend and retract the cutting blades 16, the pins 27 and 31 are offset vertically from the pins 29. Obviously, if the pins 27, 29 and 31 were aligned along a vertical center line, the pivot arms 28 would jam upon target contact and be unable to fold outwardly.

Figures 3, 4:
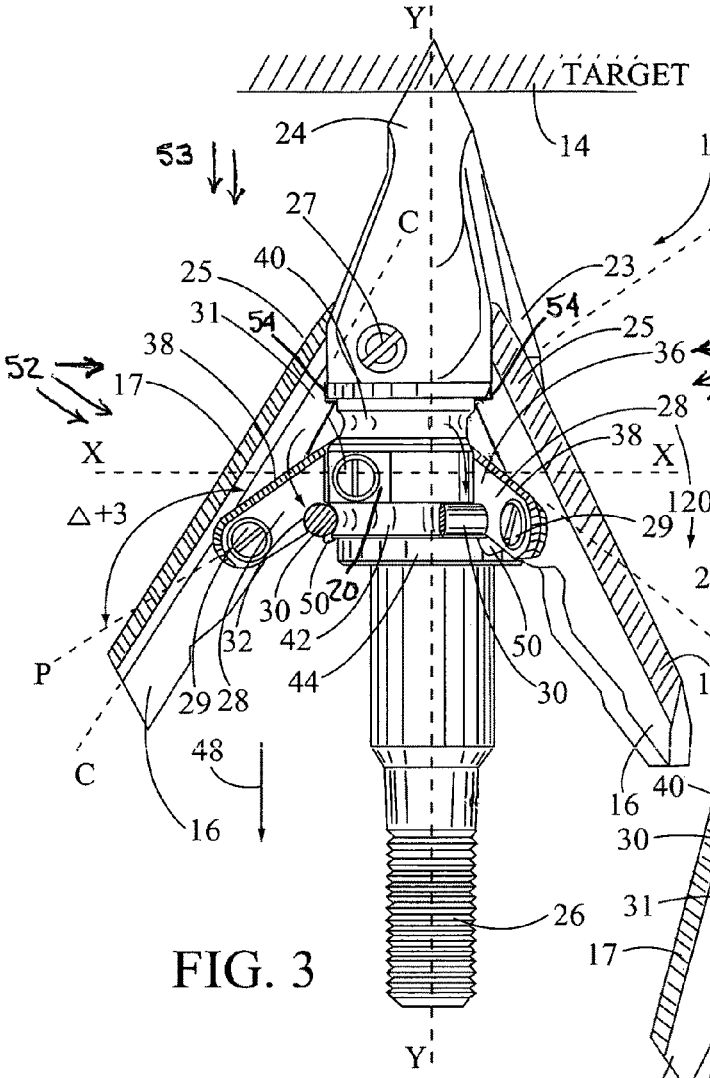
FIG. 3 is still another perspective view of the subject arrow broadhead with the pivot arms extended past 90 degrees from the vertical center line of the sliding shaft housing and the blades in a fully-locked position upon complete target contact.
FIG. 4 is another embodiment of the arrow broadhead, as shown in FIG. 1, but without a sliding shaft attached to the tip base of the pointed tip

The upper portion 18 of the sliding shaft housing 20 includes an upper groove 40 and a spaced apart lower groove 42. The groove 40 is used to receive the elastic band 30 therein when the cutting blades 16 are held in a retracted position, as shown in FIG. 1. The groove 42 is used to receive the elastic band 30 when the cutting blades 16 are held in an extended position, as shown in FIG. 3. A portion of the housing 20 between the two grooves 40 and 42 and through the pins 31 is disposed along a horizontal center line X-X.

In the upper portion 18 of the housing 20 and disposed below the lower groove 42 is a hard metal washer 44. The washer 44 is used to engage a portion of the inside edge of the pivot arms 28 to prevent the cutting blades 16, when fully extended, from contacting the side of the sliding shaft housing 20, which is made of a softer metal such as aluminum. This feature helps prevent the pivot arms and the cutting blades from overextending when the blades contact a hard material during target contact. Also, the metal washer 44 can be a magnetized, metal washer for holding the pivot arms and cutting blades in a retracted position during arrow flight, as shown in FIG. 1, and helping hold the pivot arms and cutting blades in a fully-locked and extended position, as shown in FIG. 3. The metal washer 44 is similar to the magnetic collar 88, shown in FIGS. 13 and 15.

In FIG. 2, another perspective view of the arrow broadhead 10 is shown having made initial target contact and the sliding shaft moved inwardly in the bore hole 21 of the sliding shaft housing, as indicated by arrow 46. The pivot arms 28 are now extended 90 degrees from the vertical center line Y-Y along the length of the sliding shaft housing 20. The pivot arms 28 have moved the cutting blades 16 outwardly in a fully extended position for maximum cutting. Also at this time, the bias force of the elastic band 30 is overcome and the band notch 32 has moved the elastic band 30 out of the upper groove 40 and rolled it downwardly toward the lower groove 42. In this drawing, the pivot arms 28 are shown with a beveled cutting edge 38 for increased penetration and tissue cutting during target contact.

In FIG. 3, the subject arrow broadhead 10 is illustrated with the pivot arms 28 and center line P-P extended past 90 degrees and downward toward 120 degrees from the vertical center line Y-Y of the sliding shaft housing 20. In this position, the band notch 32 has now moved the elastic band 30 into the lower groove 42. The cutting blades 16 are now fully-locked and prevented from any further rearward movement by the pivot arms 28.

Also shown in this drawing is a blade locking notch 54 on the inside of the cutting blades 16. The blade locking notch 54 is used for engaging a side of the top of the sliding shaft housing 20 for helping hold the blades in a fully-extended and locked position.

As mentioned above, the broadhead 10, using the pivot arms 28 with the elastic band 30, can be easily removed from the target 14 backwardly, as indicated by arrow 48. At this time, the cutting blades 16 and the pivot arms 28 return to their original retracted position, as shown in FIG. 1. Also, the band notch 32 in the pivot arms 28 returns the elastic band 30 to the upper groove 40. The broadhead 10 is then ready again for arrow flight. The band notch 32 will eliminate the need to manually put the elastic band 30 back in place for holding the pivot arms and cutting blades in a retracted position after every arrow shot.

Referring back to FIGS. 1-3 and during arrow flight and target contact, the following retraction and expansion of the cutting blades 16 using the pivot arms 28 occurs. As mentioned above, the length of the broadhead 10 is oriented along a vertical center line Y-Y. Also shown in FIGS. 1-3 is one of the pivot arms 28 having a center line P-P along it's length and one of the cutting blades 16 having a center line C-C along it's length.

To better understand when the cutting blades 16 and pivot arms 28 can be first collapsed into a retracted position during initial target contact, can be second moved into a fully-extended and semi-locked position during initial target contact and can be third moved into an extended and fully-locked position, the following angle Δ or delta between the center line P-P of the pivot arms and the center line C-C is discussed as follows:

In FIG. 1, the angle Δ between center lines P-P and C-C is less than 90 degrees and the pivot arms 28 and cutting blades 16 are disposed in the retracted position next to the sliding shaft housing 20 and sliding shaft 22, during arrow flight.

In FIG. 2, initial target contact has been made and the pivot arms 28, one of them shown in dashed lines, have moved outwardly extending the cutting blades 16. An angle Δ+1 between the center lines P-P and C-C is now approximately 90 degrees. At this critical point and if the angle Δ+1 is less than 90 degrees and if there is a lateral force, as shown by arrows 52, or a longitudinal force, as shown by arrows 53, on the cutting blades 16, the pivot arms 28 and cutting blades 16 will collapse back into the retracted position. The lateral force 52 and the longitudinal force 53 can occur during initial target entry by hitting bone or another hard substance.

On the other hand, if the angle Δ+1 is greater than 90 degrees, the pivot arms 28 have now moved the cutting blades 16 into a semi-locked and extended position. In this semi-locked position, the cutting blades 16 will stay in an extended position during initial target contact by any longitudinal force, shown as arrows 53. But, should the lateral force 52 occur at an angle to the direction of flight, the cutting blades 16 could collapse into the retracted position.

Also shown in FIG. 2 are two of the pivot arms 28 shown in solid lines with center line P-P aligned with the horizontal center line X-X. In this position, the cutting blades 16 are fully-extended at an angle Δ+2. This angle is clearly greater than 90 degrees between the center lines P-P and C-C and the pivot arms and the cutting blades are in a semi-locked position. In this position the cutting blades will no longer collapse into the retracted position, unless the lateral force 52 occurs and as long as the center line P-P and Y-Y is less than 90 degrees. Also, angle Δ+2 is at 90 degrees between center lines X-X and Y-Y.

Further, as the angle between the pivot arms and cutting blades increase past the angle Δ+2, as shown in FIG. 3, the cutting blades and pivot arms move into a fully-locked position and are no longer subject to any effect by the lateral force 52.

In FIG. 3, the broadhead 10 has fully engaged the target and pivot arms 28 have now moved the cutting blades 16 into the fully-locked but less than fully extended position. The angle Δ+3 is greater than the angle Δ+2 and obviously greater than 90 degrees between the center lines P-P and Y-Y. As mentioned above, the cutting blades and pivot arms are now fully-locked and won't collapse due to a lateral force 52 or a longitudinal force 53.

In FIG. 4, another embodiment of the arrow broadhead 10 is shown and similar to the view in FIG. 1. But, in this drawing, the pointed tip 24 is shown without the sliding shaft 22. While the sliding shaft 22 is important in providing additional stability and strength to the broadhead 10, this illustration shows how the pivot arms 28 attached to the cutting blades 16 can be used without the sliding shaft 22.

Figure 5:
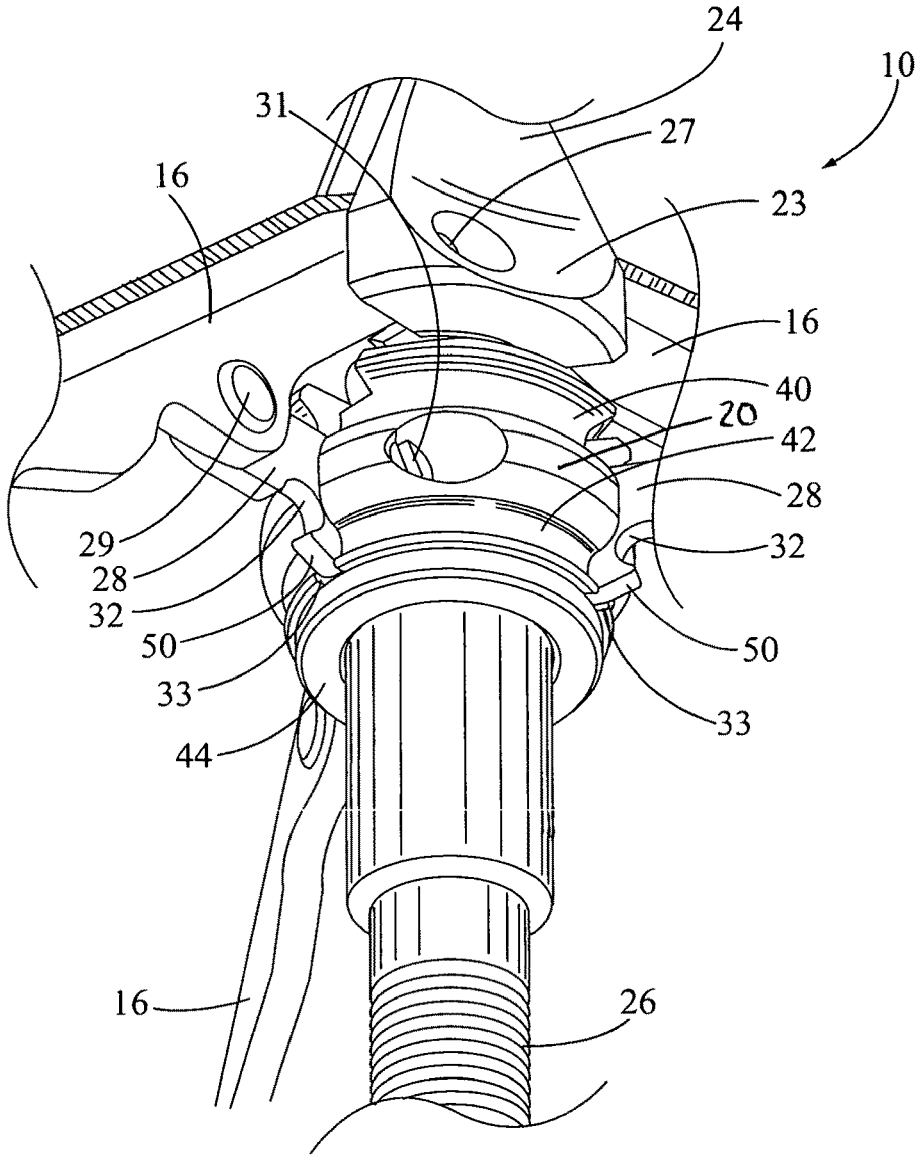
FIG. 5 is a perspective view of the lower portion of the broadhead shown in FIG. 2. This drawing illustrates the pivot arms with pivot arm notch and a hook portion for engaging the side of a metal washer mounted on this sliding shaft housing.

In FIG. 5, another perspective view of the broadhead 10 is shown with the cutting blades 16 in an extended position, as shown in FIG. 2. In this drawing, the lower portion of the pivot arms 28 with the pivot arm notch 32 is shown more clearly for receiving the elastic band 30. The elastic band is not shown in this drawing. Disposed next to the pivot arm notch 32 is a hook portion 50. When the pivot arms 30 move into a fully-locked and extended position, as shown in FIG. 3, the hook portion 50 moves against the side of the metal washer 44 to prevent further downward movement of the pivot arms and the attached cutting blades.

Figure 6:
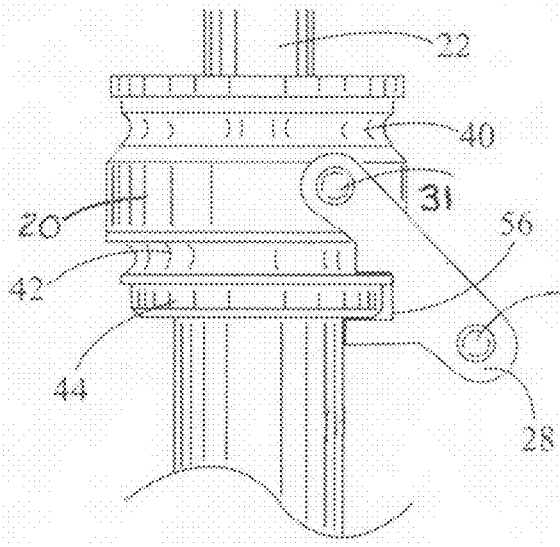
FIG. 6 is another embodiment of one of the pivot arms having a "U" shaped notch therein for engaging a portion of the metal washer and holding the cutting blades in a locked position.

In FIG. 6, another embodiment of the pivot arms 28 is shown. In this drawing, one of the pivot arms 28 is shown attached to the side of the sliding shaft housing 20 using pin 31. The cutting blades 16 aren't shown in these drawings. The pivot arm 28 includes a "U" shaped notch 56. When the pivot arms 28 are lowered into the extended position, as shown in FIG. 3, the notch 56 engages a portion of the metal washer 44 or a portion of the sliding shaft housing 20 for holding the cutting blades 16 in a fully-locked position.

Figure 7:
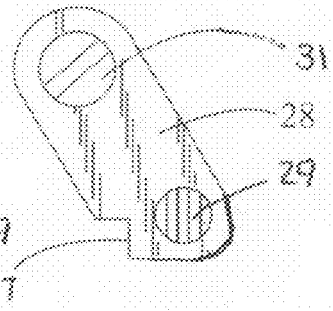
FIG. 7 is still another embodiment of one of the pivot arms having an inverted "L" shaped notch for engaging a portion of the metal washer and holding the cutting blades in a locked position.

In FIG. 7, still another embodiment of the pivot arm 28 is shown and having an inverted "L" shaped notch 57 for receipt next to a side of the washer 44 for helping hold the cutting blades 16 in a fully-locked position.

Figure 8:
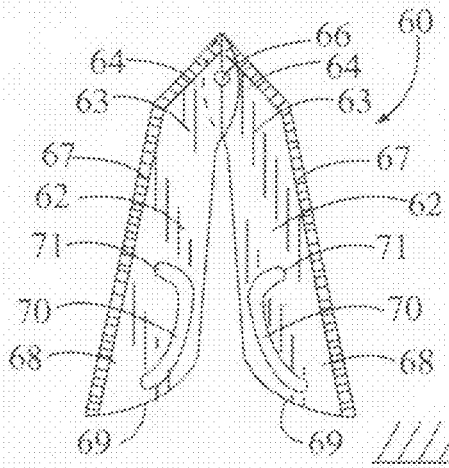
FIGS. 8, 9 and 10 illustrate side views of another embodiment of the arrow broadhead having a pair of sliding cutting blades pivotally mounted on a broadhead housing.
Figure 9:
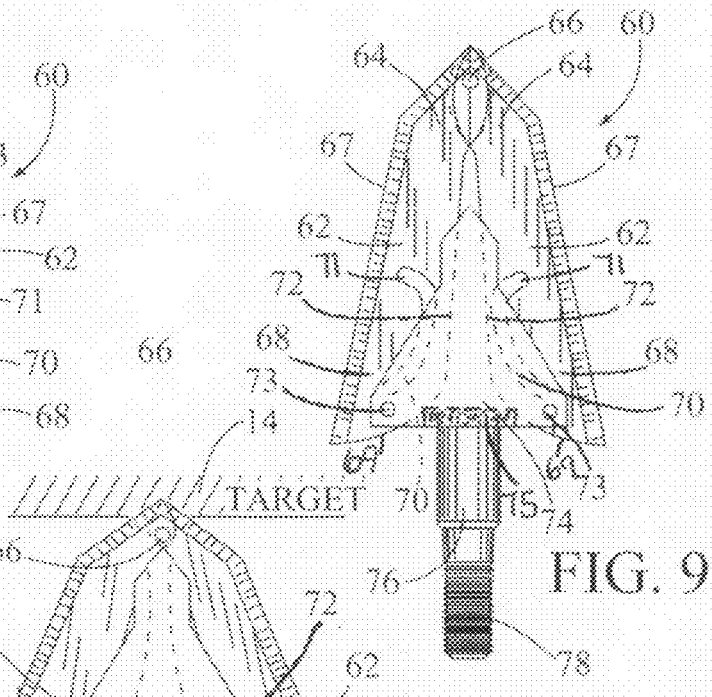
Figure 10:
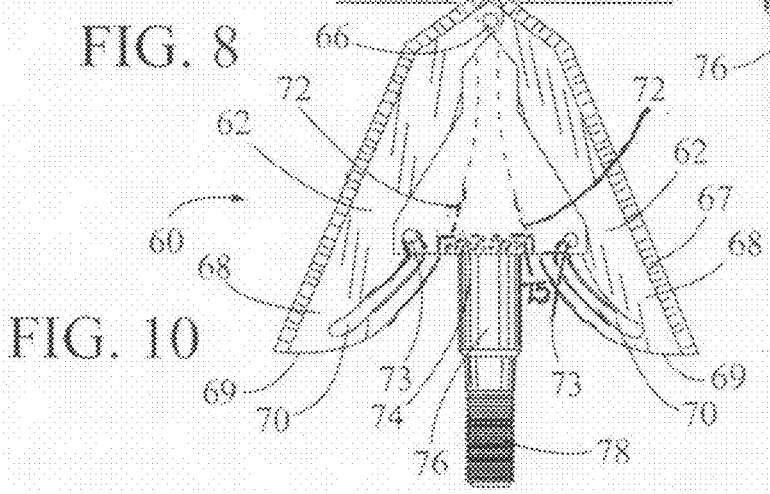

In FIGS. 8, 9 and 10, another embodiment of an arrow broadhead is shown having a general reference numeral 60. This type of broadhead has a pair of cutting blades 62 with an upper portion 63 having a pointed end 64. The two pointed ends 64 are pivotally attached using a pin 66 for retracting and expanding the broadhead 60 in a scissor-like fashion. The cutting blades 62 include a beveled, outside cutting edge 67 and an outwardly curved inside edge 69. A lower portion 68 of the cutting blades 62 includes a semi-circular opening 70. In the top of the opening 70 is a locking pin notch 71. Also, next to a side of the opening 70 is mounted a magnet 75. The magnets 75 ares used for holding the cutting blade 62 in a retracted position. Also, the magnets 75 eliminate the need for using an elastic band, O-ring, and the like for receipt around the cutting blades or attached to the cutting blades during arrow flight.

In FIG. 9, an inside edge 69 of the cutting blades 62 is slidably received in a pair of curved cutting blade grooves 72, shown in dashed lines, in the opposite sides of a broadhead housing 74. The cutting blades 62 are attached to the housing 74 using pivot pins 73 received through a portion of the housing and through the bottom of the semi-circular opening 70. Also, the housing 74 includes a downwardly extending shaft 76 with threaded end 78 for securing the broadhead to an insert in an open end of an arrow shaft. The insert and the arrow shaft aren't shown in the drawings. In this drawing, the pointed ends 64 have not contacted a target 14 and the cutting blades 64 are held in a retracted position by the magnets 75 during arrow flight.

In FIG. 10, the pointed ends 64 have contacted the target 14 and the curved inside edge of the cutting blades 62 have over come the magnetic bias force of the magnet 75 and moved downwardly and outwardly in the cutting blade grooves 72 in the broadhead housing 74. Also, the pivot pins 73 riding in bottom of the semi-circular opening 70, as shown in FIG. 9, have now moved upwardly to the top of the opening and into the pin locking notch 71 for holding the cutting blades in a fully-locked position. The broadhead 60 is now fully extended for maximum cutting and target penetration.

Figure 11:
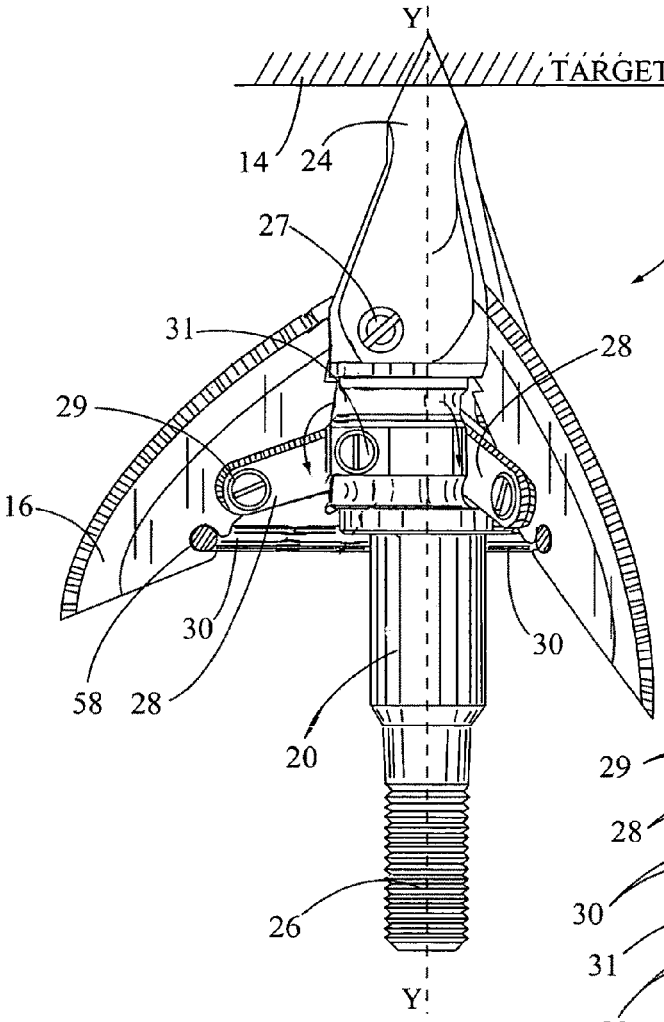
FIG. 11 illustrates another perspective view of the broadhead shown in FIG. 3 and using an elastic band attached to the cutting blades for holding the blades in a retracted position during arrow flight and in a fully-locked and extended position on target contact.

In FIG. 11, another perspective view of the broadhead 10 is illustrated using the elastic band 30 received in a cutting blade band notch 58 in the cutting blades 16. Also the elastic band 30 can be placed on various locations on the cutting blades 16. The elastic band 30 is used for holding the cutting blades 16 in a retracted position during arrow flight. Also, the elastic band 30 is used to hold the cutting blades 16 in a fully-locked and extended position similar to what is shown in FIG. 3. In this drawing, it should be noticed the cutting blades 16 are curved inwardly for reducing blade profile during arrow flight.

Figure 12:
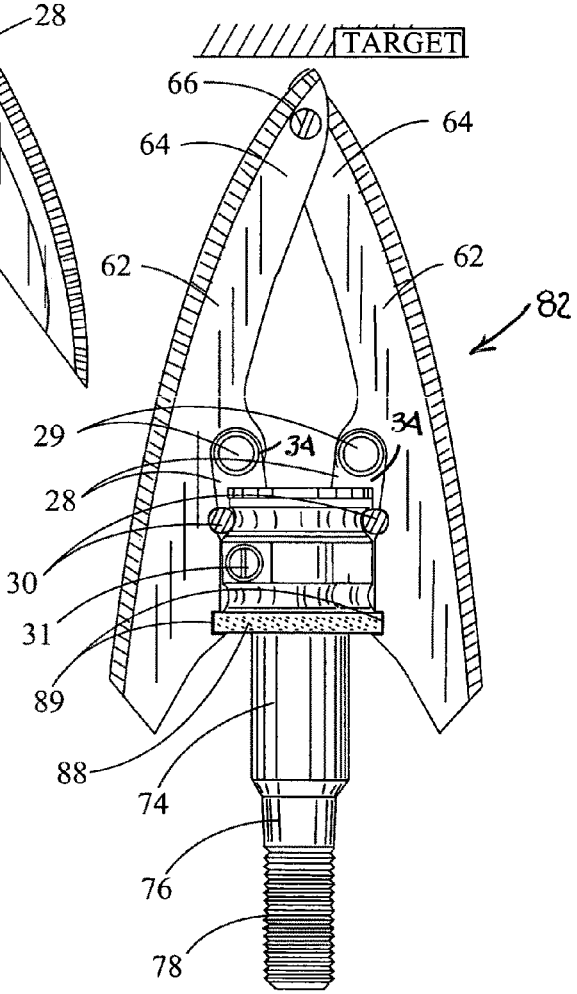
FIG. 12 shows another embodiment of the arrow broadhead with a pair of cutting blades pivotally attached to a pair of pivot arms. The pivot arms are pivotally attached to the broadhead housing.

In FIG. 12, another embodiment of the arrow broadhead is shown and having general reference numeral 82. This broadhead 82 is similar to the broadhead 60 shown in FIGS. 9 and 10, but without pivot arms. The broadhead 82 includes a pair of curved cutting blades 62 with pointed, upper portions 64 pivotally attached to a rivet or pivot pin 66. The cutting blades 62 are pivotally attached to one end 34 of the pivot arms 28 using pins 29. The opposite end of the pivot arms 28 are pivotally attached to the broadhead housing 74.

Figure 13:
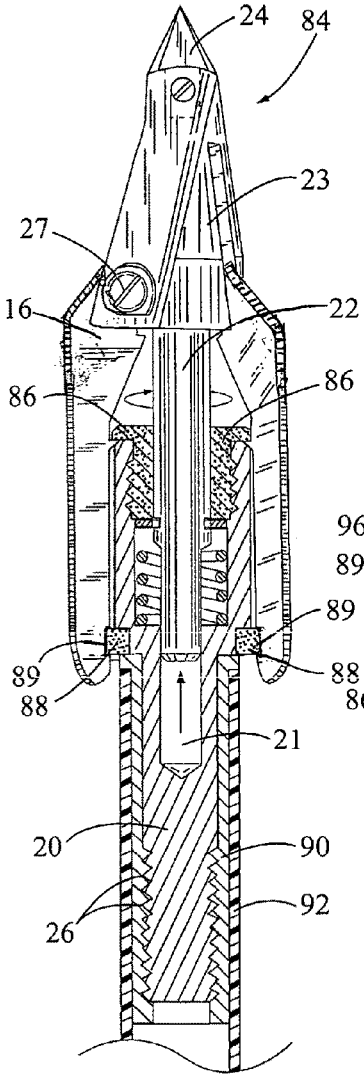
FIG. 13 is still another embodiment of the arrow broadhead having a magnetic hollow threaded collar attached to the top of the sliding shaft housing and a magnetic collar or magnetic ring mounted around a portion of the sliding shaft housing. The two magnetic collars are used to magnetically hold the cutting blades in a retracted position during arrow flight and hold the cutting blades in an extended position during target contact.

In FIG. 13, still another embodiment of the arrow broadhead is shown and having a general reference numeral 84. This broadhead 84 includes a magnetic hollow threaded collar 86 shown in cross-section with dots and attached to the top of the sliding shaft housing 20. The sliding shaft housing 20 can also include a magnetic collar 88 shown in cross-section with dots and mounted around a middle portion of the housing. A portion of the magnetic collar 88 is shown received in a magnetic cutting blade notch 89 to enhance the magnetic force thereagainst when magnetically biasing the cutting blades 16 in a retracted position. The two magnetic collars 86 and 88 are used to magnetically hold the cutting blades 16 in a retracted position during arrow flight. Also shown in this drawing is a cross-section of the threaded lower portion 26 of the sliding shaft housing 20 threaded inside an arrow insert 90 received inside a hollow end of an arrow shaft 92.

It should be mentioned that this arrow broadhead 84 is disclosed and claimed in U.S. Pat. No. 7,226,375 to the subject inventor. But, in this patent the feature of using either the magnetic hollow threaded collar 86 or a magnetic collar 88 for holding the cutting blades 16 in a retracted position isn't disclosed or shown in the patent drawings.

Figure 14:
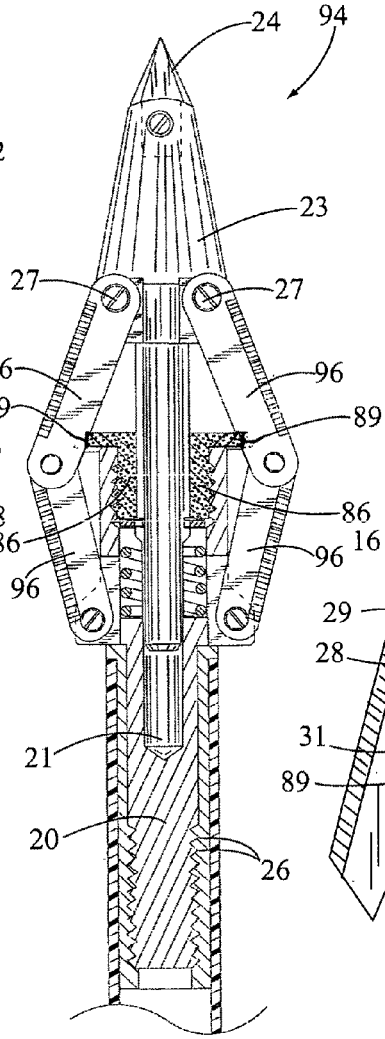
FIG. 14 is yet another embodiment of the arrow broadhead having a magnetic hollow threaded collar attached to the top of the sliding shaft housing. The magnetic collar is used to magnetically hold a pair of two-piece, folding cutting blades in a retracted position during arrow flight and to hold the blades in an extended position during target contact.

In FIG. 14, yet another embodiment of the arrow broadhead is shown having a general reference numeral 94. The broadhead 94 includes a magnetic hollow threaded collar 86 attached to the top of the sliding shaft housing 20. The magnetic collar 86 is used to magnetically hold at least two folding cutting blades 96 in a retracted position during arrow flight. This broadhead 94 is disclosed in a pending patent application Ser. No. 11/810,285, by the subject inventor. But, in this patent application the feature of using either the magnetic hollow threaded collar 86 for holding the folding cutting blades 96 in a retracted position isn't disclosed or shown in the patent application drawings.

Figure 15:
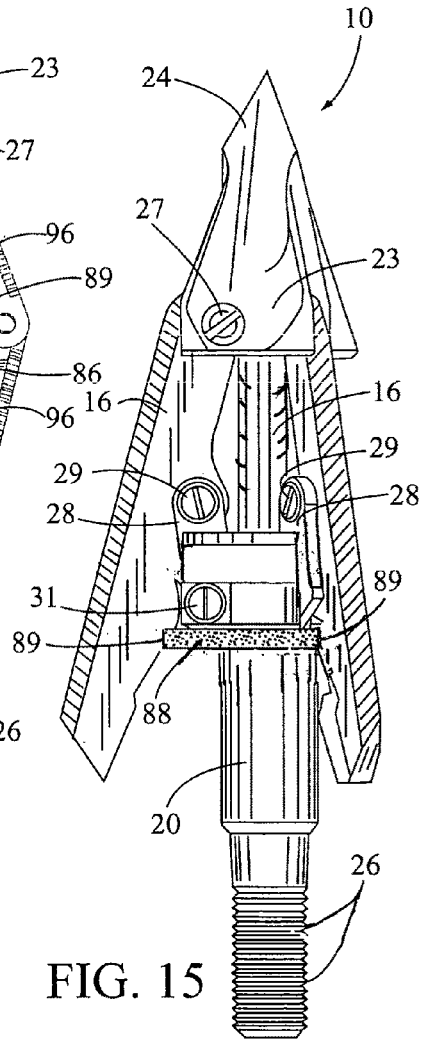
FIG. 15 illustrates a similar broadhead as shown in FIG. 1 with at least two cutting blades pivotally attached to pivot arms. The pivot arms are pivotally attached to the sliding shaft housing. The sliding shaft housing includes a magnetic collar therearound for holding the cutting blades in a retracted position during arrow flight.

In FIG. 15, the subject broadhead 10 is shown with at least two cutting blades 16 pivotally attached to the pivot arms 28. The pivot arms 28 are pivotally attached to the sliding shaft housing 20. In this example, the sliding shaft housing 20 includes the magnetic collar 88 therearound for holding the cutting blades in the retracted position.

In the above described FIGS. 13, 14 and 15, the broadheads are shown having either the magnetic hollow threaded collar 86 or the magnetic collar 88 or both. By using the magnetic collars or rings of different sizes and shapes it can be appreciated that the use of an elastic band, an O-ring or similar elastic holding device isn't required to hold the cutting blades or pivot arms in a retracted position during arrow flight.

While the invention has been particularly shown, described and illustrated in detail with reference to the preferred embodiments and modifications thereof, it should be understood by those skilled in the art that equivalent changes in form and detail may be made without departing from the true spirit and scope of the invention as claimed except as precluded by the prior art.

The embodiments of the invention for which an exclusive privilege and property right are claimed are defined as follows:

1. An arrow broadhead adapted for attaching to an open end of a hollow arrow shaft, the broadhead adapted for moving from a retracted position during arrow flight to an extended and fully-locked position when contacting a target, the broadhead comprising:

a sliding shaft having a pointed tip at one end, the pointed tip tapered rearwardly and outwardly forming a tip base;

a sliding shaft housing having a bore hole therein for receiving the sliding shaft therein, a lower end of the sliding shaft housing adapted for receipt inside the open end of the hollow arrow shaft, the sliding shaft housing having a vertical center line Y-Y along a length thereof;

at least two cutting blades pivotally attached at one end to the tip base, the cutting blades having an outside cutting edge; and pivot arms having one end pivotally attached to the cutting blades, the pivot arms having an opposite end pivotally attached to a portion of the sliding shaft housing, a width across the portion of the sliding shaft attached to the opposite end of the pivot arms having a horizontal center line X-X therethrough, the pivot arms holding the cutting blades in a retracted position during arrow flight;

whereby, when the pointed tip contacts the target, the sliding shaft moves rearward in the bore hole in the siding shaft housing and the cutting blades are pivoted outwardly into an extended position by the pivot arms, the cutting blades are pivoted outwardly into an extended and fully-locked position when the pivot arms are pivoted greater than 90 degrees from the center line Y-Y.

2. The broadhead as described in claim 1 wherein the pivot arms have a center line P-P through the length thereof and the cutting blades have a center line C-C through the length thereof, when the pointed tip contacts the target, the sliding shaft moves rearward in the bore hole in the siding shaft housing and the cutting blades are pivoted outwardly into an extended position by the pivot arms, the cutting blades are pivoted outwardly into a fully extended and semi-locked position when the center line P-P of the pivot arms is pivoted greater than 90 degrees from the center line C-C of the cutting blades.

3. The broadhead as described in claim 1 further including an elastic band mounted on the pivot arms and a portion of the sliding shaft housing, the elastic band biasing the pivot arms and cutting blades into a retracted position next to the sliding shaft housing during arrow flight.

4. The broadhead as described in claim 3 wherein a portion of the sliding shaft housing includes an upper groove and a lower groove therein, a portion of the elastic band received in the upper groove during arrow flight, the elastic band received in the lower groove using the band notch upon target contact.

5. The broadhead as described in claim 4 further including a band notch in the pivot arms, the band notch receiving a portion the elastic band therein for moving the elastic band from the upper groove to the lower groove.

6. The broadhead as described in claim 5 wherein the band notch holds the elastic band in the upper groove when the pivot arms are in a retracted position and the band notch hold the elastic band in the lower groove when the pivot arms are in an extended and fully-locked position.

7. The broadhead as described in claim 6 further including a hook portion or a notch in the pivot arms and disposed next to the band notch for engaging and holding the cutting blades in an extended and fully-locked position.

8. The broadhead as described in claim 4 further including a metal washer mounted on the sliding shaft housing and next to the lower groove, the washer preventing further movement of the pivot arms and cutting blades when in a fully-locked and extended position upon target contact.

9. The broadhead as described in claim 8 wherein the metal washer is a magnetic metal washer for biasing the pivot arms and cutting blades in a retracted position during arrow flight and helping bias the pivot arms and cutting blades in a fully-locked and extended position upon target contact.

10. The broadhead as described in claim 1 further including a coil spring mounted in the bore hole, the coil spring engaging the sliding shaft and biasing it upwardly in the bore hole for biasing the pivot arms and cutting blades in a retracted position during arrow flight and in a fully-locked and extended position when the pivot arms are pivoted greater than 90 degrees from the center line Y-Y.

11. The broadhead as described in claim 1 further including an elastic band mounted in a cutting blade band notch in the cutting blades, the elastic band biasing the pivot arms and cutting blades into a retracted position next to the sliding shaft housing during arrow flight and biasing the pivot arms and cutting blades in a fully-locked and extended position upon target contact.

12. The broadhead as described in claim 1 further including a blade locking notch in the cutting blades, the blade locking notch engaging a portion of the sliding shaft housing when the cutting blades are in an extended and fully-locked position.

13. An arrow broadhead adapted for attaching to an open end of a hollow arrow shaft, the broadhead adapted for moving from a retracted position during arrow flight to an extended and fully-locked position when contacting a target, the broadhead comprising:

a sliding shaft having a pointed tip at one end, the pointed tip tapered rearwardly and outwardly forming a tip base;

a sliding shaft housing having a bore hole therein for receiving the sliding shaft therein, a lower end of the sliding shaft housing adapted for receipt inside the open end of the hollow arrow shaft, the sliding shaft housing having a vertical center line Y-Y along a length thereof;

at least two cutting blades pivotally attached at one end to the tip base, the cutting blades having an outside cutting edge, the cutting blades having a center line C-C along a length thereon; and pivot arms having one end pivotally attached to the cutting blades, the pivot arms having an opposite end pivotally attached to a portion of the sliding shaft housing, a width across the portion of the sliding shaft attached to the opposite end of the pivot arms having a horizontal center line X-X therethrough, the pivot arms having a center line P-P along a length thereof, the pivot arms holding the cutting blades in a retracted position during arrow flight;

whereby, when the pointed tip contacts the target, the sliding shaft moves rearward in the bore hole in the siding shaft housing and the cutting blades are pivoted outwardly into an extended position by the pivot arms, the cutting blades are pivoted outwardly into a fully extended and semi-locked position when the center line P-P of the pivot arms is pivoted greater than 90 degrees from the center line C-C of the cutting blades and whereby, when the pointed tip contacts the target, the sliding shaft moves rearward in the bore hole in the siding shaft housing and the cutting blades are pivoted outwardly into an extended position by the pivot arms, the cutting blades are pivoted outwardly into an extended and fully-locked position when the pivot arms are pivoted greater than 90 degrees from the center line Y-Y.

14. The broadhead as described in claim 13 further including an elastic band mounted on the pivot arms and the upper portion of the sliding shaft housing, the elastic band biasing the pivot arms and cutting blades into a retracted position next to the sliding shaft housing during arrow flight, the sliding shaft housing having an upper groove and a lower groove therein, the pivot arms having a band notch therein for receiving a portion of the elastic band, the band notch holding the elastic band in the upper groove when the pivot arms are in a retracted position during arrow flight, the band notch holding the elastic band in the lower groove when the pivot arms are in a fully-locked and extended position.

15. The broadhead as described in claim 13 further including a coil spring mounted in the bore hole, the coil spring engaging the sliding shaft and biasing it upwardly in the bore hole for biasing the pivot arms and cutting blades in a retracted position during arrow flight and biasing the pivot arms and cutting blades in a fully-locked and extended position when the pivot arms are pivoted greater then 90 degrees from the center line Y-Y.

16. The broadhead as described in claim 13 further including a metal washer mounted on the sliding shaft housing, the washer preventing further movement of the pivot arms and cutting blades when in a fully-locked and extended position upon target contact.

17. The broadhead as described in claim 16 wherein the metal washer is a magnetic metal washer for biasing the pivot arms and cutting blades in a retracted position during arrow flight and helping bias the pivot arms and cutting blades in a fully-locked and extended position upon target contact.

18. The broadhead as described in claim 13 further including an elastic band mounted in a cutting blade band notch in the cutting blades, the elastic band biasing the pivot arms and cutting blades into a retracted position next to the sliding shaft housing during arrow flight and biasing the pivot arms and cutting blades in a fully-locked and extended position.

* * * * *